US005150895A

United States Patent [19]

Berger

[11] Patent Number: 5,150,895

[45] Date of Patent: * Sep. 29, 1992

[54] METHOD OF AND SYSTEM FOR DETERMINING A POSITION OF BALL RELATIVE TO A PLAYING FIELD, AND BALL PROVIDED THEREFOR

[76] Inventor: Richard Berger, 30 Cold Spring Hills Rd., Cold Spring Hills, N.Y. 11743

[ * ] Notice: The portion of the term of this patent subsequent to Jan. 21, 2009 has been disclaimed.

[21] Appl. No.: 757,898

[22] Filed: Sep. 11, 1991

Related U.S. Application Data

[63] Continuation-in-part of Ser. No. 609,703, Nov. 6, 1990, Pat. No. 5,082,263.

[51] Int. Cl.[5] ..... A63B 61/00

[52] U.S. Cl. ..... 273/29 R

[58] Field of Search ..... 240/323 R; 273/29 R, 273/29 A, 31, 61 R, 185

[56] References Cited

U.S. PATENT DOCUMENTS

| | | | |
|---|---|---|---|
| 3,774,194 | 11/1973 | Jokay et al. | 273/31 |
| 3,854,719 | 12/1974 | Supran | 273/29 R |
| 3,883,860 | 5/1975 | Konorn | 273/31 |
| 4,109,911 | 8/1978 | Van Auken | 273/29 A |
| 4,257,594 | 3/1981 | Conroy et al. | 273/29 A |
| 4,422,647 | 12/1983 | Wilson et al. | 273/29 R |
| 4,673,183 | 6/1987 | Traham | 273/185 |
| 4,855,711 | 8/1989 | Harrop et al. | 273/29 R |
| 4,866,414 | 9/1989 | Diaconu et al. | 273/29 R |

*Primary Examiner*—Theatrice Brown
*Attorney, Agent, or Firm*—Alfred M. Walker

[57] ABSTRACT

A ball is provided with a radar signal reflecting element, so that during a game a radar sends a signal to the ball and receives a reflected signal which is compared by a computer with a stores position of a playing field to determine a position of the ball relative to the playing field.

4 Claims, 2 Drawing Sheets

Fig. 1
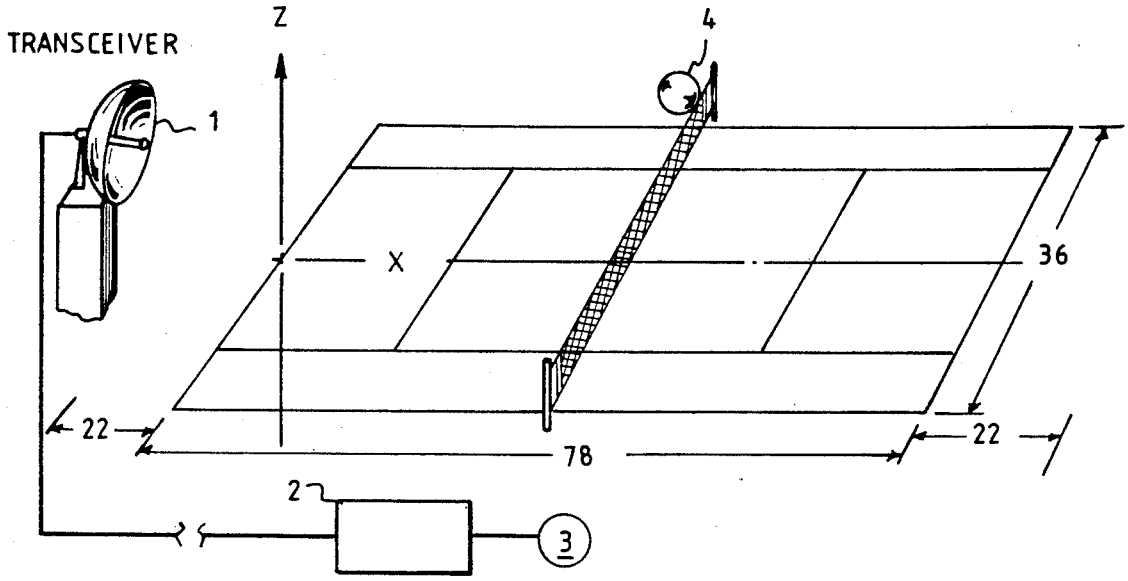
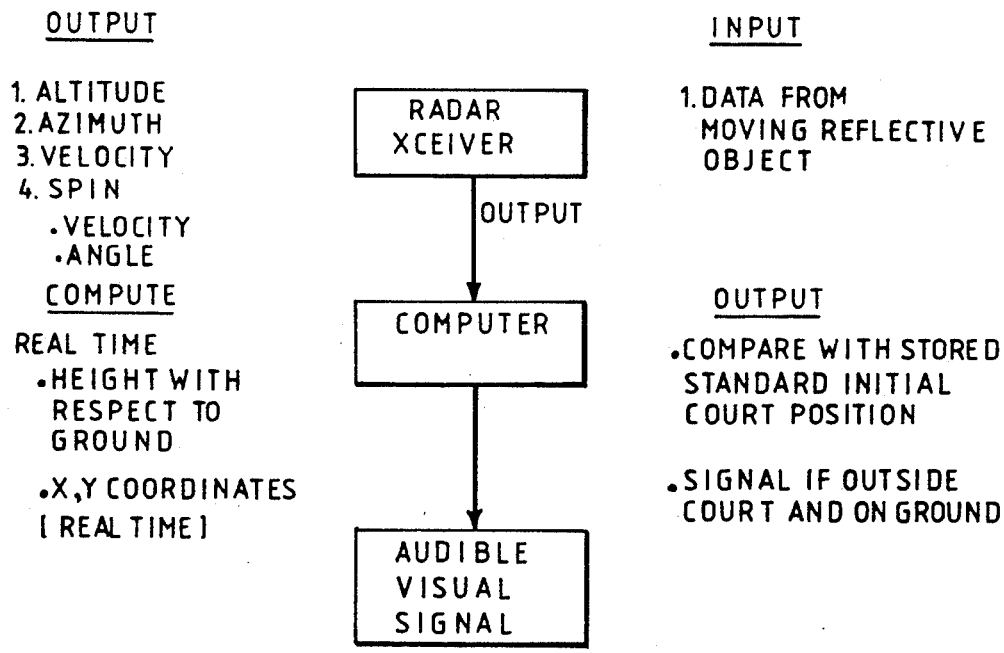
Fig. 2

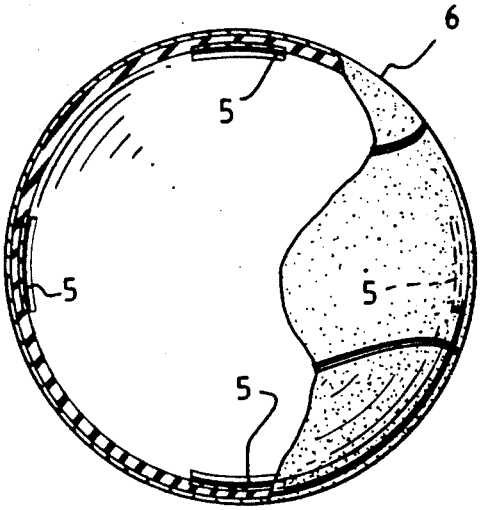
Fig. 3
Fig. 4
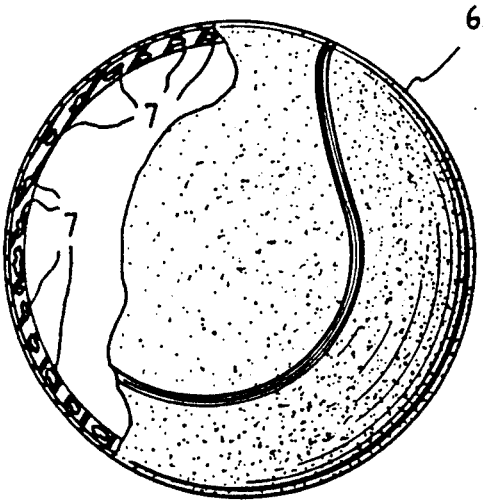
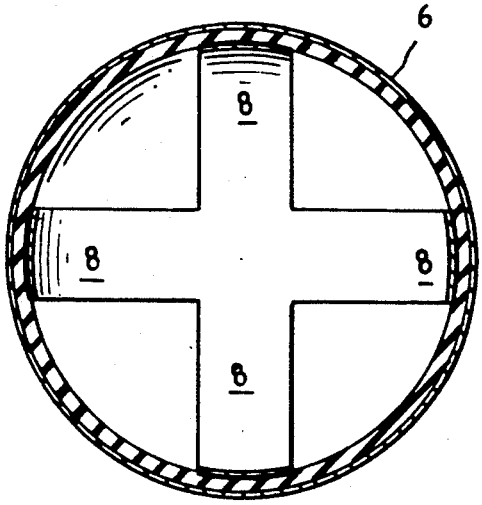
Fig. 5

METHOD OF AND SYSTEM FOR DETERMINING A POSITION OF BALL RELATIVE TO A PLAYING FIELD, AND BALL PROVIDED THEREFOR

This application is a continuation-in-part of application Ser. No. 07/609,703, filed Nov. 6, 1990, now U.S. Pat. No. 5,082,263.

BACKGROUND OF THE INVENTION

The present invention relates to a method of and a system for determining a position of a ball relative to a playing field during a game involving repetitive volleying back and forth, such as tennis, volleyball or soccer.

Methods and systems of the above mentioned general type are known in the art. Optical and contact type electrical devices have been used to determine a position of a ball on a playing field during a game. In accordance with known methods, photosensitive electric eyes are used on boundary lines, or electrical contacting tapes are arranged along the edges of the playing field. The disadvantages of the optical devices are that a plurality of the electric eyes must be installed. Furthermore, they can be interfered with when a player runds between the ball and the electric eye. The disadvantages of the contacting tapes are that they require additional digging and placement of the tapes below and/or at the surface and connecting them to alarm device. Another method uses magnetically sensitive devices under the playing field. These have the disadvantages of requiring modifications to the ball which substantially change their playing characteristics. Modifications to make a ball magnetically sensitive are much more extensive than modifications to make a ball radar sensitive, and being magnetically sensitive affects the way the ball plays.

SUMMARY OF INVENTION

Accordingly, it is an object of the present invention to provide a method of and a system for determining a position of a ball during a game, which avoid the disadvantages of the prior art.

More particularly, it is an object of the present invention to provide a method and a system of the above mentioned type, which is easy to install and has a high accuracy and reliability in determining the position of the ball with respect to the boundaries of a playing field.

It is also an object of the present invention to provide a ball which can be used with the inventive method and system.

In keeping with these objects and with the other which will become apparent hereinafter, one feature of the present invention resides, briefly stated, in a method and system in which a ball is provided with a radar signal deflecting element, a radar sends a signal to the ball and receives a reflected signal, and a computer compares the received signal with a stored position of a playing field and thereby determines a position of a ball relative to the playing field, such as a tennis court, volleyball court or soccer playing field.

In accordance with another especially advantageous feature of the present invention, a visual and/or audio alarm can be activated when the computer determines that the ball hits the ground beyond predetermined limits of the playing field.

Another advantageous feature of the present invention is that the radar reflecting element of the ball can be formed so that spin characteristics of the ball in its flight can be determined as well.

The novel features of the present invention are set forth in particular in the appended claims. The invention itself, however, will be best understood from the following description of preferred embodiments, which is accompanied by the following drawings.

BRIEF DESCRIPTION OF THE DRAWINGS

FIG. 1 is a view which schematically shows a system for determining a position of the ball, such as a tennis ball, relative to a playing field such as a tennis court, in accordance with the present invention;

FIG. 2 is a view which schematically shows a flow chart diagram of computations for the inventive system;

FIG. 3 is a view showing a ball in accordance with one embodiment of the present invention, for use with the inventive system; and FIGS. 4 and 5 are views which show two further modifications of the ball for use with the inventive system.

DESCRIPTION OF PREFERRED EMBODIMENTS

A system for determining a position of a ball, such as a tennis ball, relative to a playing field, such as a tennis court, in accordance with the present invention includes a radar sending and receiving device (radar transmitter/receiver or radar transceiver) which is identified with reference numeral 1, a computer connected with the radar device and identified with 2, an alarm signal producing element 3, and a ball 4 provided with radar signal reflection means.

The radar device is formed as a well known commerically available device for providing information related to a distance, velocity and angular direction of a target relative to the device. One example of such devices is an automobile speed checking device or a pitchball speed measuring radar device. In a preferred embodiment the transceiver operates at a target sampling rate of 10 khz. This will produce an uncertainty with respect to the position of the ball of $+/-0.132$ inches, at a maximum ball speed of 150 miles per hour. At lower speeds the uncertainty will be proportionally less.

A typical layout for a playing field, such as a tennis court, is shown in FIG. 1. For example, a tennis court has a playing area bound by a fence, etc. The fence is usually between 20 and 25 feet beyond each baseline. With an average of 22 feet, the overall playing area of a tennis court is 122 feet long. The radar transceiver 1 is mounted 0 to 150 feet behind the fence, and 20 to 75 feet above the level of the playing surface, on the centerline of the tennis court. In the usual position of 42 feet behind the baseline and 20 feet above the surface of the court, the solid angle of view for the outer limits of the court for tennis doubles is 10 degrees vertical and 40 degrees horizontal for the near line, narrowing to 17 degrees at the far baseline. For the court for singles, the horizontal angles drops to 26.5 degrees at the far baseline narrowing to about 6.5 degrees at the near baseline.

It is noted that the radar transceiver is similarly located for other playing fields, such as volleyball courts or soccer playing fields.

Under some circumstances, the physical restraints of the playing area may not permit the transceiver to be positioned far enough away from the court to track the ball within the acceptance angle of the transceiver. The transceiver would then have to be mounted on a tracking platform whose output would also have to be input to the computer for processing.

The computer 2 connected with the radar device 1 can operate at a processing rate of 1 to 10 MIPS. This processing range will accommodate real time processing of the output data of the transceiver at 10,000 khz. The computer program contains an initialization procedure in order to store the playing field position with reference to the position of the transceiver. This can be done by direct measurements with a tape measure or laser operated surveying equipment, or other means available. The playing field/transceiver distances are then input to the program and further used as the reference area for comparison.

The ball 4, such as a tennis ball depicted in FIGS. 3–5, is provided with a radar signal reflecting means which will be explained in detail later on.

As shown in the flow chart diagram of FIG. 2, during the play, the radar 1 tracks the ball 4 and outputs actual raw data which define its position with respect to the position of the radar. The computer 2 transforms these data to X, Y, Z coordinates of the ball and compares them with the stored position of the court. More particularly, when the Z coordinate or height above the playing field surface becomes equal to O, the X and Y coordinates of the spot of impact of the ball with the ground are compared with the coordinates of the predetermined outer limits of the playing field area, which are stored in the memory of the computer. If the impact of the ball is determined as being outside the legally defined playing field or court area, a signal is emitted by the device 3, which allows the official to call the ball out. The device 3 can be interfaced with the output ports of the computer 2, to flash lights, to make all sorts of sounds, etc.

The ball 4 can be made reflective to the radar waves by providing additional radar waves reflecting means. As shown in FIG. 3, metallic or metallized plastic foils 5 can be attached to an inner surface of a main ball body 6. As shown in FIG. 4, a plurality of metallic particles 7 can be embedded in the main body 6 of the ball such as a tennis ball, which is composed of rubber compound with a felt outer cover. The metallic particles can be embedded in any of these parts of the ball body, or in both of them. In accordance with an especially preferred embodiment of the present invention, a radar discernible pattern of stripes can be attached to the inner surface of the ball body, as identified with 8, in order to gather additional information about the flight of the tennis ball with regard to its spin condition, in particular the angular velocity and orientation of the spin axis.

Other types of balls which repetively move back and forth across a playing field, such as a volleyball, soccer ball, or football, may be similarly constructed.

It is to be understood that the very material of the ball can be considered as the above specified means for reflecting the radar waves, as long as it provides such a reflection. Balls which are not detectable by a radar at all cannot be used for the present invention.

In one particular embodiment, such as a tennis game, the inventive system is able to determine the spin characteristics of the tennis ball as follows. In this particular embodiment, since the metallic foils only cover part of the interior surface of the tennis ball, the spin of the ball can be ascertained by determining the spin of the foil pieces located within the ball. If the strips of foil are used, as the ball spins, the radar waves reflect back intermittently whenever the waves strike a strip of foil. When the strip of foil turns within a ball spin, the radar waves stop receiving the reflections from the foil strip as the foil strip goes away from the apex of the curve of the tennis ball closest to the radar waves. The waves then sequentially receive a second reflection when the foil strip fully circumnavigates the interior of the tennis ball until the foil strip again reaches the apex of the curve of the tennis ball closest to the radar waves. Using the Doppler effect, the computer can then compare the speed and direction of the waves reflected off of the foil strips to determine whether the tennis ball has a back spin, etc.

In another embodiment of the invention, the entire interior ball surface may have a reflective foil. In such a case the spin characteristics could not be determined because one would not be able to track the position of the individual foils with respect to their direction and velocity as the ball and foils spinned respectively.

In either embodiment, the system repeatedly and randomly determines the position of the tennis ball during a dynamic tennis game, where the ball is hit randomly in volleys until the ball is out of bounds.

Another example of how the system is used may be made with reference to FIGS. 1 and 2. Commercially available single vector radar devices can be used to detect the position of a ball with respect to X, Y, Z coordinates of a playing field by locating the ball within the playing field, such as a tennis court. In such a system the X coordinate can represent the baseline, the Y coordinate can represent the sideline, and the Z coordinate can represent the vertical distance of the ball above the playing field. By bouncing radar waves against the ball, which waves are reflected back to the radar reflecting means, data is provided to a computer, and thereafter to the user as to where the ball is with respect to the baseline, sideline and vertical height above each. As stated previously, when the ball is outside of the pre-determined limits of the X and Y coordinates and the Z coordinate equals zero, the ball is considered to be out of bounds and an audible and/or visual signal is provided that the particular play of the ball is over. However, if the ball does not reach the zero Z coordinate, the ball remains in play, even if the ball is considered to be outside of the pre-determined boundaries of the X and Y coordinates. The radar receives reflective data from where the ball is in contact with the surface, such as the ground within the X and Y coordinates, and is determined to be within the pre-determined playing field boundaries, and therefore within bounds. Or, if the ball is struck during play, it is also considered to be in bounds within the pre-determined court boundaries, since the Z coordinate is not at zero.

In certain circumstances where one wishes to use the system where the ball is considered out even if the Z coordinate is not only at ground level at zero, the system can be adjusted to so reflect this modification of the Z coordinate.

During a dynamic play, wherein the ball is randomly hit, pushed or kicked repeatedly by the respective tennis, volleyball or soccer players on each side of predetermined positions of the playing field, either with respect to a net at midpoint or without a net, the computer sequentially receives the signal from the ball when the ball is in bounds under either of the above cited conditions and compares the received signal with the stored position of the playing field so as to determine a position of the ball relative to the playing field, such as a tennis court. The computer locates the ball on said defined X, Y, Z coordinates and determines whether the ball is located out of bounds as defined by said X, Y, Z coordinates, emits a perceivable signal indicating the location, and stops the determination when the location of said ball is determined to be out of bounds as defined by said X, Y, Z coordinates. If the ball is found not to be out of bounds, the computer sequentially redetermines the location of the ball if the ball is determined to be in bounds, as defined by said X, Y, Z coordinates, until said ball is struck again. Thereafter the computer redetermines the position of the ball with respect to the X, Y, Z coordinates with each successive strike of said ball, from the previously determined position of the ball on the playing field, such as a volleyball or tennis court, until said ball is determined to be out of bounds, and then emits a second perceivable signal locating said ball and stops the determination.

At no point is the ball being struck at the same position on the defined court. Therefore, the computer repetitively and sequentially determines the location of the ball during and after a series of random strikes of the ball on the playing field at random locations.

In the present invention there is a moving player who strikes, pushes or kicks the ball from one position to another position where the ball is measured and it is then subsequently struck again by another playing at a randomly placed position. The position of the ball is constantly being redetermined in a continuous loop system until it is determined that the ball is located outside of the defined X, Y, Z coordinates defining the playing field boundaries.

The present invention is different from existing radar determining systems which measure the position of a ball, such as a golf ball, from a stationary position, such as a tee position. Applicant is not merely measuring the location of a ball from a fixed position. On the contrary, Applicant's system repeatedly re-determines the ball from random locations from where the ball is struck, pushed or kicked, or where the ball strikes the ground while in bounds. In addition, the present inventive device needs no embedded reflective means along the edge of the court boundaries.

The present invention is of course not limited to the details shown since various modifications and structural changes are possible without departing in any way from the spirit of the present invention.

What is desired to be protected by Letters Patent is set forth in particular in the appended claims.

I claim:

1. A method of determining a position of a ball relative to a playing field, comprising the steps of:

providing a radar sending and receiving device;

arranging a means for reflecting a radar signal against a radar reflective ball;

connecting the radar with a computer which stores various positions located upon said playing field, said positions being designated within a three dimensional spatial relationship defined by X, Y, Z coordinates;

determining the baseline of said playing field as an X coordinate, the sideline as a Y coordinate and the height above the playing field as a Z coordinate;

sending by radar said signal to a moving ball during a game and receiving a signal from said ball by said radar;

comparing said received signal by said computer with the stored position of said playing field so as to determine a position of said ball relative to said playing field;

locating said ball on said defined X, Y Z coordinates;

determining, whether said ball is located out of bounds as defined by said X, Y, Z coordinates, emitting a perceivable signal indicating said location, stopping said determination when said location of said ball is determined to be out of bounds as defined by said X, Y, Z coordinates, or, alternatively, redetermining the location of said ball if said ball is determined to be inbounds as defined by said X, Y, Z coordinates until said ball is struck again, and redetermining the position of said ball with respect to the X, Y, Z coordinates with each successive strike of said ball from the previously determined position of said ball on said playing field until said ball is determined to be out of bounds, emitting a second perceivable signal locating said ball and stopping said determination.

2. A system for determining a position of a tennis ball relative to a tennis court, comprising:

a radar sending and receiving device;

a means for reflecting a radar signal against;

a computer connectable to said radar and said means, which computer stores various positions located upon a playing field, said positions being designated within a three dimensional spatial relationship defined by X, Y, Z coordinates; said computer being capable of determining the baseline of said playing field as an X coordinate, the sideline as a Y coordinate and the height above the playing field as a Z coordinate; said computer being capable of sending by radar said signal to said ball during a game-play and receiving a signal from said ball by said radar;

means for comparing the received signal with the stored position of said playing field so as to determine a position of said ball relative to said playing field;

means for locating said ball on said defined X, Y, Z coordinates and determining whether said ball is located out of bounds as defined by said X, Y, Z coordinates, means for emitting a perceivable signal indicating said location of said ball, means for stopping said determination when said location of said ball is determined to be out of bounds as defined by said X, Y, Z coordinates, or, redetermining the location of said ball if said ball is determined to be inbounds as defined by said X, Y, Z coordinates until said ball is struck again, means for redetermining the position of said ball with respect to the X, Y, Z coordinates with each successive strike of said ball from the previously determined position of said ball on the playing field until said ball is determined to be out of bounds, and means for emitting a second perceivable signal locating said ball and stopping said determination.

3. The device as in claim 2, wherein said ball includes a radar reflective foil upon the interior circumference of said ball.

4. The device as in claim 2, wherein said ball includes a strip of radar reflective foil encircling a portion of the interior circumference of said ball.

* * * * *

UNITED STATES PATENT AND TRADEMARK OFFICE

CERTIFICATE OF CORRECTION

PATENT NO. : 5,150,895
DATED : September 29, 1992
INVENTOR(S) : Richard Berger

It is certified that error appears in the above-indentified patent and that said Letters Patent is hereby corrected as shown below:

In Claim 2, column 6, line 25 of the Patent, after "against", add --a radar reflective ball--.

Signed and Sealed this
Fifth Day of July, 1994

Bruce Lehman

*Attest:*

BRUCE LEHMAN

*Attesting Officer*

*Commissioner of Patents and Trademarks*